United States Patent [19]

Reil

[11] Patent Number: 4,934,585

[45] Date of Patent: Jun. 19, 1990

[54] PACKAGING CONTAINER FOR FOODSTUFFS

[75] Inventor: Wilhelm Reil, Bensheim, Fed. Rep. of Germany

[73] Assignee: Tetra Pak Finance & Trading S.A., Pully, Switzerland

[21] Appl. No.: 399,981

[22] Filed: Aug. 29, 1989

[30] Foreign Application Priority Data

Sep. 6, 1988 [DE] Fed. Rep. of Germany ..... 3830224

[51] Int. Cl.[5] ..... B65D 3/08; B65D 3/26

[52] U.S. Cl. ..... 229/106; 229/160.2; 229/123.1; 220/258; 220/270; 220/276

[58] Field of Search ..... 229/4.5, 106, 93, 123.1, 229/160.2; 220/258, 270, 276

[56] References Cited

U.S. PATENT DOCUMENTS

| | | | |
|---|---|---|---|
| 2,309,341 | 1/1943 | Condon | 229/4.5 |
| 2,398,505 | 4/1946 | Pepin | 229/4.5 X |
| 2,415,906 | 2/1947 | Paige | 229/93 X |
| 4,564,139 | 1/1986 | Reil | 229/106 X |

FOREIGN PATENT DOCUMENTS

| | | | |
|---|---|---|---|
| 351936 | 6/1931 | United Kingdom | 220/270 |

*Primary Examiner*—William Price

*Attorney, Agent, or Firm*—Burns, Doane, Swecker & Mathis

[57] ABSTRACT

The invention describes a packaging container for jams, comprising a tube-shaped part (6) which consists of synthetic plastics coated paper and on one edge (9) of which there is an integrally molded closure means (5) which consists only of synthetic plastics material, with no carrier material and which has an annular surface (13) and an opening device (16 to 20), with a closure wall (16) at the end of an annular collar (4), the wall (16) being adapted to be torn out along a line of weakness (17) by a gripper device (20).

The invention of such a container with a screwed closure means which has the necessary sealing-tightness and which can be produced in a similar way to milk containers is characterized in that the annular collar (4) is provided with an external screwthread (3) and in that a separate screwed lid with an internal screwthread can be screwed onto the annular collar (4), covering the closure wall (16) and gripper device (20).

7 Claims, 2 Drawing Sheets

PACKAGING CONTAINER FOR FOODSTUFFS

The invention relates to a packaging container for liquids, pastes or the like, particularly for foodstuffs, having a tube-shaped part which consists of a plastics-lined paper or the like and on one edge of which there is integrally moulded a fastening which consists solely of synthetic plastics material, with no carrier material and which has an annular surface and an opening device with a closure wall at the end of an annular collar and which is adapted to be torn out along a line of weakness by means of a gripper device.

For foodstuffs, e.g. jams, jellies or the like, a number of containers are already being used. Generally, these consist of a glass body in the form of a jar which is closed at the top by means of a screwed lid.

For milk, fruit juices, wine and the like, however, packaging containers are also known which have a tube-shaped part with the aforementioned features. Of the numerous packagings available for milk or the like, there are also all manner of constructions of closure means, but none of these is constructed as a screwed fastening with a screw cap, particularly since this would not guarantee the necessary sealing-tightness of the package.

The object of the present invention is to provide a packaging container for liquids, particularly foodstuffs, which has the features mentioned at the onset and which nevertheless has a screwed closure which has the necessary sealing-tightness and which can be assembled, filled and sealed by similar production methods as those used for containers for milk, fruit juices and the like.

In order to resolve this problem, it is according to the invention proposed that the annular collar be provided with an external screwthread and that a separate screw cap with an internal screwthread can be screwed onto the annular collar sealing the closure wall and the gripper device. A jam jar which consists of glass does indeed also have an annular collar with an external screwthread in its upper portion but this consists of glass and is open both during manufacture and also during use. When the prior art jam jars are stored and transported, the necessary closure is provided by the separate screwed lid with the internal screwthread which can be screwed onto the annular collar and which is generally provided with suitable sealing means to make the container sufficiently tight for storage and transport of the jar of jam or honey. Such sealing means which also act in particular by the screwed lid being pressed firmly on the end edge of the annular collar cannot however be achieved in the case of packaging containers on which the closure means consists of synthetic plastics material, with no carrier material and is in addition integrally moulded onto the edge of a paper tube. The combination of the per se known features does not therefore lead to any solution to the problem.

Nevertheless, the invention follows the per se contradictory route to a solution in that in fact the closure wall which is intended to be torn out initially provides a sealing-tight closure, the features of a jam jar also being provided; namely, for the situation when, after the packaging container has been opened for the first time, the end user has removed the closure wall so that the new packaging container is thereafter used as a jam jar.

The advantage resides first and foremost in the inexpensive production of the new packaging container in large quantities on machines on which packagings for milk, juices and the like can be produced. The injection moulding techniques for injection moulding closure means on tube-shaped parts which consist of paper are already known. In addition, the invention sees a possibility of providing the annular collar with an external screwthread which can be produced by the injection moulding tools and which can also be easily removed from the mould.

As in the case of conventional jam jars, the screwed cap or lid can be produced on separate machines and kept in store. These machines may even take complicated forms so that the internal screwthread of the separate screwed lid can be made so that it fits reliably on the external screwthread on the annular collar. The liquids containers which can be produced at a high rate of output on prior art machines only requires to be combined with the screwed lid in a separate working station. All the other stages and processes in the production are the same as in the case of milk packagings.

In consequence, a packaging is available for jams and the like which can be regarded as a mass-production item and which has the necessary sealing-tightness during storage, transport and on the consumer's premises.

Furthermore, it is advantageous if the closure wall lies in the plane extending through the free edge of the annular collar. When the packaging container is full, the annular collar constitutes the topmost part, so that the plane extending through the top of the free edge substantially constitutes the topmost plane of the packaging as a whole. If the closure wall is disposed in this plane, then it is possible not only to produce simple injection moulding tools but also the optimum volume for the new packaging container can be achieved. The line of weakness for tearing open the closure wall by means of the gripper device, extending substantially through 360° along the free edge of the annular collar is then likewise capable of being very practically produced in one horizontal plane and is accessible to the user.

It is furthermore advantageous for the invention if the annular surface of the closure extends from the edge of the tube-shaped part in a flat or frustoconical configuration as far as the inner edge of the annular collar. The edge of the annular collar which is opposite the aforementioned free edge of the annular collar which is at the top is the inner edge which has just been refereed to because it is at this edge that the annular collar is internally fitted, i.e. the edge which extends downwardly towards the main body of the container. From these inner edge, or attachment edge, the aforementioned annular surface of the closure member extends radially outwardly and, when viewed in cross-section, extends flat in the case of one embodiment and frustoconically or obliquely in the other embodiment. In both cases, the annular surface receives in respect of the tube-shaped part a component which extends at right-angles to the longitudinal central axis through the tube so that such an annular surface creates a very favourable stiffening for the packaging container.

In the case of prior art glass jam jars, the rigidity required for the consumer and also producer as well as the retailer is provided by the material because generally thick glass is used. If the man skilled in the art wishes to replace this plastics coated paper, then he must justifiably entertain serious doubts concerning rigidity, particularly in the upper portion of the closure means. However, by reason of the aforesaid annular surface, the top edge of the tube-shaped part acquires the necessary rigidity, because the forces within the annular surface are braced on the generally circular edge of the tube. Although mention has only been made of one annular surface of the closure means, it can also be differently shaped, i.e. the top edge of the tube-shaped part can also be of quadrilateral construction. The outer edge of the closure means is substantially polygonal when the container is viewed in the longitudinal direction and one is looking at the closure means. The preferred embodiment, however, consists of a round closure means which is injection moulded onto a round tube-shaped part.

According to the invention, it is furthermore expedient for the closure wall to be constructed as a film. The manufacturer of the package will always endeavour to save on material. Thin walls are sealing-tight, it is true, just as they are also a means of saving on material, but they are generally not suitable for the end user, because a jam jar with no screwed lid, the closure of which is only sealed at the top by a film, would be too easily damaged. According to the invention, however, by reason of the external screwthread on the annular collar and the possibility of making a screwed joint with the separate screwed lid, the film is assured adequate protection. For filling the tube-shaped part with jam, honey or other foodstuffs, from the bottom end, however, the strength of the closure wall is adequate when it is a film. After the container has been sealed, it is in any case envisaged that the screwed lid will be screwed on, the gripping device and the closure wall, i.e. in this case the film, being completely covered and thus also protected from external shocks or penetrating forces.

Where various packages are concerned, it has been demonstrated that integrally moulded closure means become detached from the annular edges of the tube-shaped parts or at least the end cut edge of the tube, which is unprotected having no coating of plastics material, becomes so exposed that liquids can penetrate the fibres of the paper and destroy the packaging. In order to circumvent this problem, the invention suggests that the edge of the tube-shaped part have synthetic plastics material injection moulded along its edge as well as on its inside and outside surfaces. Since for the tube and its closure means, at both lid and bottom ends, only the injection moulding machine for producing the closure means in question has to be taken into account and suitably constructed, it is possible to provide suitable measures for injection moulding material completely around the exposed edge of the tube-shaped part of the package. The radially outermost part of the closure means engages around the end edge of the tube-shaped part like a unilaterally open ring, so reliably covering the unprotected parts of the paper while also ensuring a particularly rugged and reliable glued joint by heating of thermoplastics materials, if such materials are used. Furthermore, this three-sided moulding around the edge of the tube-shaped part ensures a high degree of strength both at the lid end for the tube-shaped part itself and also for the integrally moulded closure means. It is in fact when handling a glass jam jar that the consumer requires that such a packaging container offer good stability at the lid end.

In an advantageous further development of the invention, the gripper device is constructed as a bar extending diagonally over the closure wall and fixed at both ends. Gripper devices for tearing open films, foils or closure panels are known in all manner of constructions. Such gripper devices can take the form of hooks, rings, loops or the like. In the case of certain liquids packaging, it is also already envisaged for the closure wall to be torn open by a gripper ring which engages at one location on the circle. According to the invention, then, the diagonal disposition and in plan view rectilinear construction of the gripper device in rod form has been chosen because it not only improves the possibility of grasping the gripper device so that it can more satisfactort act on the closure wall which is to be torn open, but such a rod-shaped device can also be more easily covered by the screwed lid. However, probably the most important advantage lies in the fact that the middle of the rod serves as a centre for the material introduction point for the synthetic plastics material from which the entire closure means is produced. Therefore, the manufacturing machine uses the rod-shaped gripper device or the passage provided for it in order to cause the still fluid synthetic plastics material for forming the closure means to flow in as it is integrally moulded on the edge of the tube-shaped part.

According to the invention, it is also expedient if the tube-shaped part is round at the lid end and quadrilateral at the opposite end, being sealed by means of folded tabs. For the man skilled in the art, it will be appreciated that circular tools are technically more easily controlled than quadrilateral tools, so that from the outset, the desire is to have a circular shape at the lid end of the tube-shaped part. Furthermore, it should be possible for the new packaging container to be used as a jam container and the end user likewise wishes to have practical emptying orifices and in practice the circular shape has proved very successful. Since the main body of the packaging container consists of synthetic plastics coated paper or the like, so that the paper or cardboard is not pervious to liquids, the bottom closure of the tube-shaped part can be differently constructed from the lid end. It is known for cardboard or paper packages for milk to be sealed by creases and tabs followed by a heat sealing process. The invention can benefit from this advantage, with the further advantage during production that the tube which is open at both ends is at the lid end connected to the lid and is then filled from the bottom, whereupon the bottom is sealed, and only afterwards (or naturally also in a preceding operation) can the separate screwed lid be screwed onto the closure means. It will be appreciated that here the film-like closure wall permits of a particularly practical production of filled jam containers which consist of paper and synthetic plastics material.

Further advantages, features and possible applications of the present invention will emerge from the ensuing description of examples of embodiment, reference being made to the accompanying drawings, in which.

Figure 1:
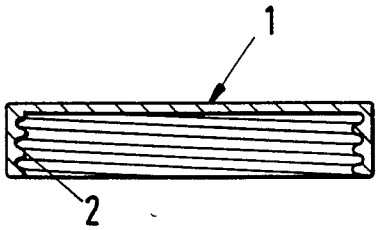
FIG. 1 is a vertical cross-sectional view through separate screwed lid with an internal screwthread.

The screwed lid 1 shown in FIG. 1 takes the form of a cylinder closed at one end and having an internal screwthread 2. Therefore, the screwed lid 1 is closed at the top and opened at the bottom so that it can be screwed onto an external screwthread 3 on an annular collar 4 on a closure means generally designated 5.

Figure 5:
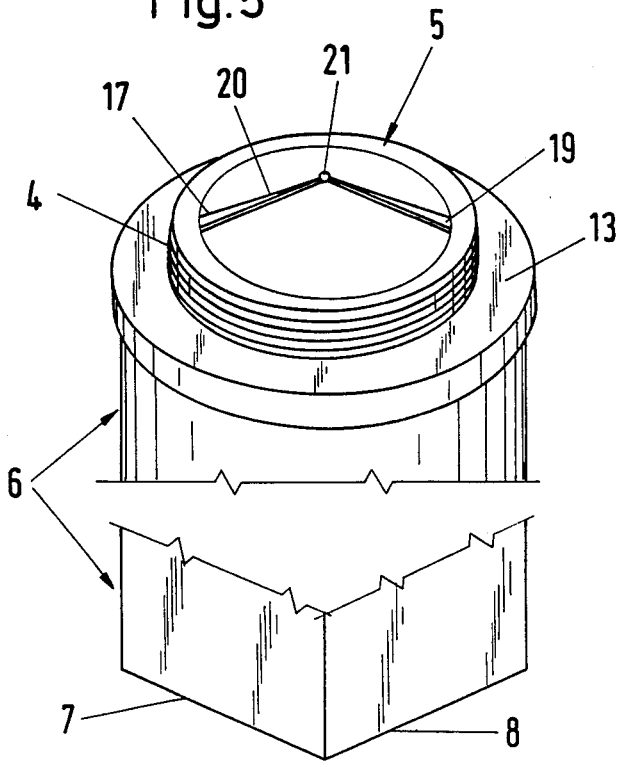
FIG. 5 is an overall perspective view, broken away in the centre, of a packaging container having a closure means and after the screwed lid has been removed.

FIG. 5 is a perspective view of the overall container with the tube-shaped part 6, which is of quadrilateral cross-section at the bottom end and kwhich is therefore folded along the four lateral folded edges and the end edges of which only the edges 7 and 8 are shown and is closed at the bottom forming triangular lugs, not shown. At the opposite lid end—particularly evident in FIGS. 2 and 3—is the exposed edge 9 of the tube-shaped part 6 which in the embodiment shown here is circular and predetermines a first inner plane 10.

Figure 2:
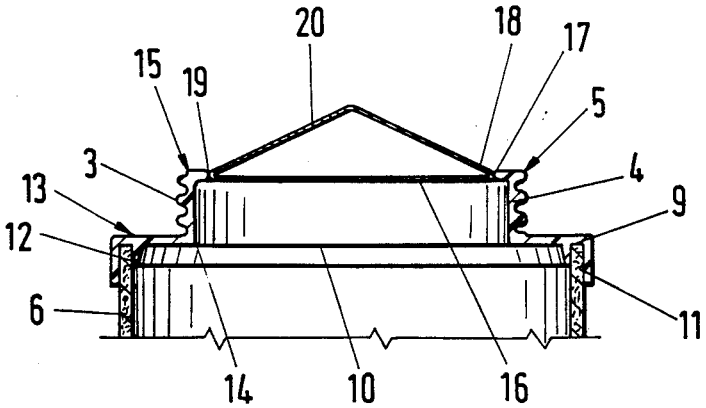
FIG. 2 is a broken away vertical sectional view through a container with a closure means with no screwed on screwed lid, in a first embodiment.
Figure 3:
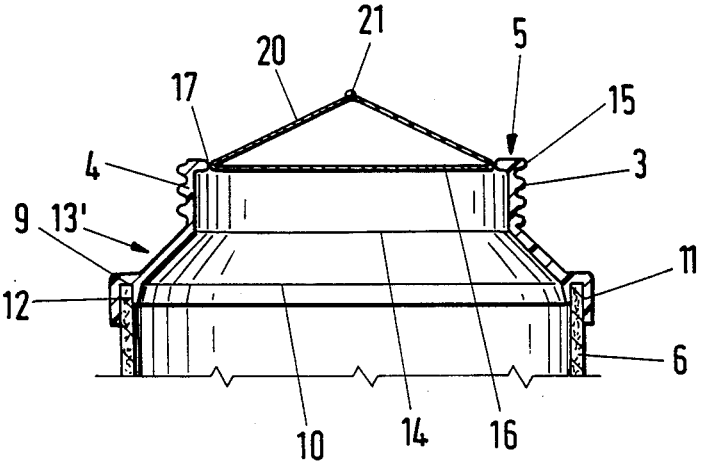
FIG. 3 is the same view as in FIG. 2 but refers to a second embodiment having a frustoconical annular surface.
Figure 4:
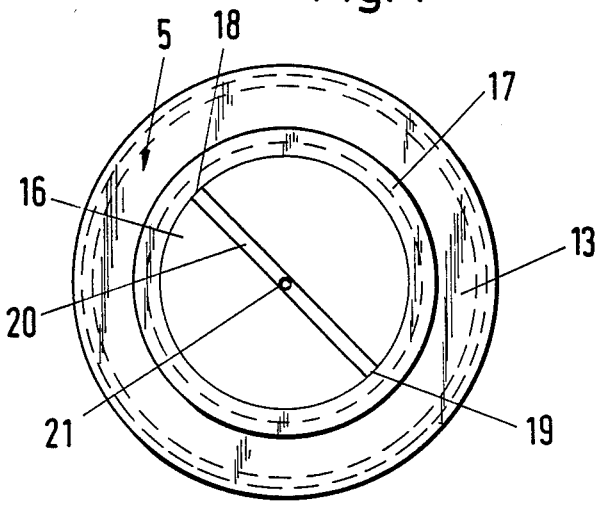
FIG. 4 is a plan view of the package closure means once the screwed lid has been removed.

The closure means 5 shown in plan view in FIG. 4 and in cross-section in FIGS. 2 and 3 is integrally moulded on and in the region of this edge 9 of the tube-shaped part 6 so that both the end edge 9 of the tube-shaped part 6 (at the top in FIGS. 2 and 3) and also the annular zone receive an enclosing injection of material on the outside and inside which are designated 11 and 12. Thus, the closure means 5 is securely anchored to the lid end of the tube-shaped part 6. Starting from this anchoring enclosing moulding along the edge 9 there is an annular surface 13 which is seen to be flat in the first embodiment shown in FIGS. 2, 4 and 5, namely substantially in or parallel with the plane 10.

In the case of the other embodiment shown in FIG. 3, this annular surface is designated 13' and is of frustoconical shape. It is only in this that the embodiment shown in FIG. 3 differs from that shown in FIG. 2.

The annular surface 13 and 13' ends inwardly in a circular edge 14 which is at the same time the aforementioned inner or attachment edge of the annular 4. Viewed from the interior of the packaging, the circular annular collar 4 is outwardly and upwardly adjacent this portion of the edge 14. The drawings show the external screwthread 3 of this annular collar 4.

Outwardly and upwardly the annular collar 4 ends in a free edge 15, this likewise circular free edge 15 establishing a plane which extends parallel with the plane 10 and in which lies the closure wall 16. It is connected to the annular collar 5 by a line of weakness 17 extending over 360°. The line of weakness 17 is interrupted at the two ends 18 and 19 of a rod-shaped gripper device 20 to form points of attachment, i.e. the material at the locations 18 and 19 is stronger than in the region of the line of weakness 17. The centre 21 of the gripper rod 20 serves at the same time as a material introduction point for the synthetic plastics material at the time of production. Therefore, it is evident how the gripper rod 20 extends diagonally and transversely over the entire closure wall 16.

To produce the new packaging container, firstly the paper tube 6 is made, being initially open at both ends, having fold and embossed lines at the bottom end, of which FIG. 5 shows only the lines 7 and 8, so that the block bottom closure can be produced. Open at both ends, this tube is then sealed at the edge 9 to the closure means 5 by a moulding process, after which the tube is turned upside down, filled and closed and sealed along the aforesaid fold lines. The screwed lid 1 is then screwed onto the external screwthread 3, both the rod-shaped handle 20 and also the closure wall 16 being completely covered and thus protected.

The packaging container produced in this way can be stored and transported.

Firstly, the end user unscrews the screwed lid 1, grips the rod-shaped gripper device 20 and tears out the closure wall 16. Consequently, the container has an opening like a jam jar and nevertheless has a really rigid closure device 5.

Two sheets of drawings

I claim:

1. A packaging container for liquids, pastes or the like, particularly for foodstuffs, having a tube-shaped part (6) which consists of a plastics-lined paper or the like and on one edge (9) of which there is integrally moulded a fastening (5) which consists solely of synthetic plastics material, with no carrier material and which has an annular surface (13, 13') and an opening device (16 to 21) with a closure wall (16) at the end of an annular collar (4) and which is adapted to be torn out along a line of weakness (17) by means of a gripper device (20), characterised in that the annular collar (4) is provided with an external screwthread (3) and in that a separate screw cap (1) with an internal screwthread (2) can be screwed onto the annular collar (4) sealing the closure wall (16) and the gripper device (20).

2. A container according to claim 1, characterised in that the closure wall (16) lies in the plane extending through the free edge (15) of the annular collar (4).

3. A container according to claim 1, characterised in that the annular surface (13, 13') of the cap (5) extends from the edge (9) of the tube-shaped part (6) in a flat or frustoconical configuration as far as the inner edge (14) of the annular collar (4).

4. A container according to claim 1, characterised in that the closure wall (16) is constructed as a film.

5. A container according to claim 1, characterised in that the edge (9) of the tube-shaped part (6) has both the end face and also the inner and outer surfaces sprayed with synthetic plastics material.

6. A container according to claim 1, characterised in that the gripper device (20) is constructed as a rod which is fixed at both ends (18, 19) and which extends diagonally over the closure wall (16).

7. A container according to claim 1, characterised in that the tube-shaped part (6) is round at the closure edge (9), is quadrilateral at the opposite end (7, 8) and is closed by means of folded tabs.

* * * * *